US005865409A

United States Patent [19]

Nimer

[11] Patent Number: 5,865,409

[45] Date of Patent: Feb. 2, 1999

[54] BRACKET SUPPORT FOR UTILITY BASKET

[76] Inventor: Fred Nimer, 1325 Swailes Rd., Troy, Ohio 45373

[21] Appl. No.: 844,105

[22] Filed: Apr. 28, 1997

Related U.S. Application Data

[60] Provisional application No. 60/017,209 May 13, 1996.

[51] Int. Cl.[6] ..... E06C 7/14

[52] U.S. Cl. ..... 248/210; 220/570; D3/308

[58] Field of Search ..... 248/210, 238, 248/312, 224.41, 271, 224.43, 312.1, 313, 225.11; 220/570, 571, 572, 500, 752, 771; D3/306, 307, 308, 206; 206/164, 198, 199, 201

[56] References Cited

U.S. PATENT DOCUMENTS

| | | | |
|---|---|---|---|
| D. 386,616 | 11/1997 | Nimer | D3/308 |
| 693,127 | 12/1902 | Gardner et al. | 248/243 |
| 4,702,446 | 10/1987 | Brown | 248/210 |
| 4,776,550 | 10/1988 | Storey | 248/210 |
| 5,052,581 | 10/1991 | Christ et al. | 220/570 |
| 5,060,898 | 10/1991 | Chang | 248/224.1 |
| 5,184,749 | 2/1993 | Attenasio | 220/572 |

*Primary Examiner*—Leslie A. Braun
*Assistant Examiner*—Tan Le
*Attorney, Agent, or Firm*—William Weigl

[57] ABSTRACT

A suspending system for supporting one or more brackets from a utility basket includes a pair of conventional, vertically-aligned keyhole slots in a side wall of the basket, but further utilizes a slot in an adjacent horizontal lip of the basket to add rigidity to the basket as well as support for the bracket after installation. The use of the keyhole slots enables a bracket to be installed or removed quickly if desired, without requiring tools for the installation or removal.

4 Claims, 2 Drawing Sheets

BRACKET SUPPORT FOR UTILITY BASKET

This invention relates to a utility basket which serves to hold tools, materials and supplies while the basket is supported at the top of a stepladder, and is particularly directed to a bracket or hanger which is mounted at an exterior of the basket for also supporting tools, materials or supplies. The application is based on U.S. Provisional Patent Application Ser. No. 60/017,209, filed May 13, 1996.

BACKGROUND OF THE INVENTION

Suspension brackets, even of the shape illustrated, have been known and used in this particular environment. They are typically mounted with conventional screws to the relatively thin vertical side walls of the basket, often putting severe strain on the fasteners whenever a heavy load such as a gallon can of paint is hung from the bracket.

SUMMARY OF THE INVENTION

A suspending system for supporting one or more brackets from a utility basket includes a pair of conventional, vertically-aligned keyhole slots in a side wall of the basket, but further utilizes a slot in an adjacent horizontal lip of the basket to add rigidity to the basket as well as support for the bracket after installation. The use of the keyhole slots enables a bracket to be installed or removed quickly if desired, without requiring tools for the installation or removal. This permits easy relocation of the bracket in the event a particular job being performed is best facilitated by repositioning a bracket to a different side or end of the basket other than the one where it had been located previously.

DESCRIPTION OF THE PREFERRED EMBODIMENT

Figure 2:
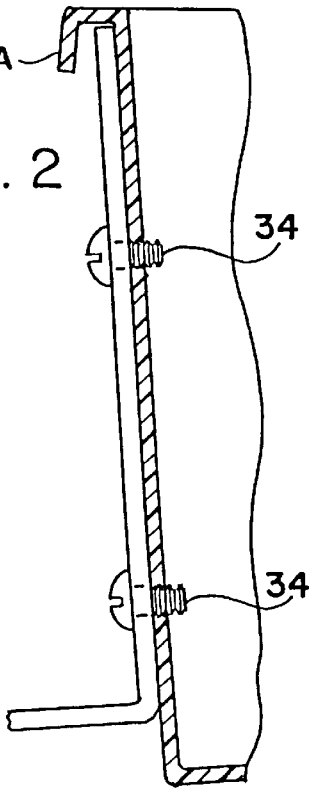
FIG. 2 PRIOR ART
FIG. 2 is a cross-sectional, fragmentary elevational view of the prior art type of bracket support used in this environment.

A stepladder 10 is positioned in a location to perform a task such as changing fluorescent lighting tubes, painting a wall, ceiling or trim, washing windows or a large variety of other tasks. Mounted atop the stepladder is a utility basket 12 having a bail 14 which pivots over the top of the stepladder and holds the basket within easy reach of a person standing on ladder steps. The utility basket 12 typically has a carrying handle 16, a plurality of compartments 18 and 20, a bottom wall 22, a pair of side walls 24, a pair of end walls 26 and an outer lip 28 or ledge surrounding the tipper edges of the side and end walls 24 and 26. The lip 28 provides stability to the side and end walls 24 and 26. The basket 12 is produced from any of several different kinds of thermoplastics, and the walls are relatively thin for cost-saving purposes, on the order of three-sixteenths of an inch in thickness. The portion of the basket constituting the lip 28 is formed in an inverted U-shape to add further strength to the basket, as seen in FIGS. 3–5.

Figure 1:
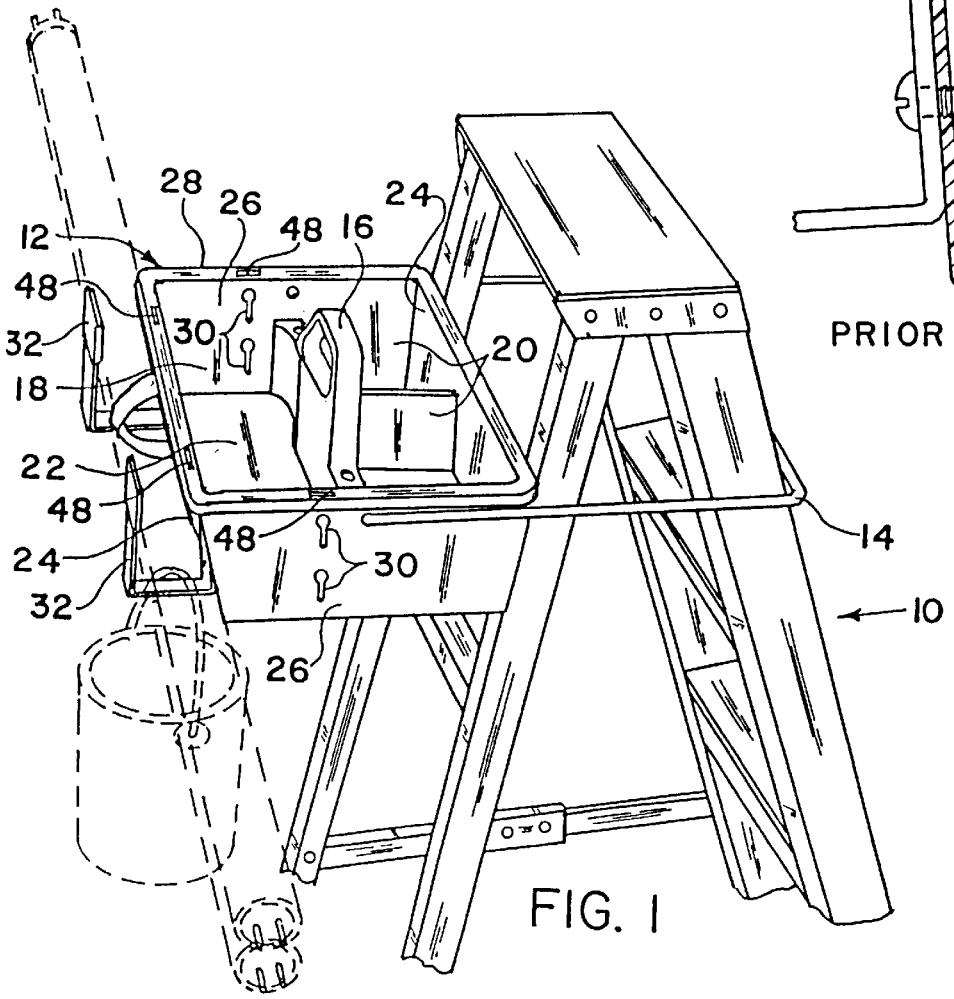
FIG. 1 is a perspective view of a stepladder containing a utility basket having the novel bracket support of my invention.

As noted in FIG. 1, vertically-aligned pairs of keyhole slots 30 are provided in one or more of the side and end walls 24, and 26. The slots 30 cannot be seen in the left side wall 24 of FIG. 1, where they are spaced apart horizontally and capable of suspending a pair of U-shaped brackets 32 for supporting elongated objects such as fluorescent lamps. As will be apparent, the brackets 32 may be repositioned from one of the side walls 26 by disassembling them from the left side wall 24 and placing them or one of them on an end wall 26. If both side and end walls are to be used for mounting brackets, it is preferred that all slots 30 be in the walls surrounding compartment 18. This allows compartments 20 to be kept watertight for containing liquid, if desired. Regardless of which wall a bracket is on, it may also be used to support things such as the bail of a paint can, a washing rag or rags, a tool having a support ring which can be placed over the outer end of a bracket, and has many other uses, as well. The purpose is to provide as much flexibility to use of the basket 12 as possible, with minimum trips up and down the stepladder to perform the intended task.

Figure 3:
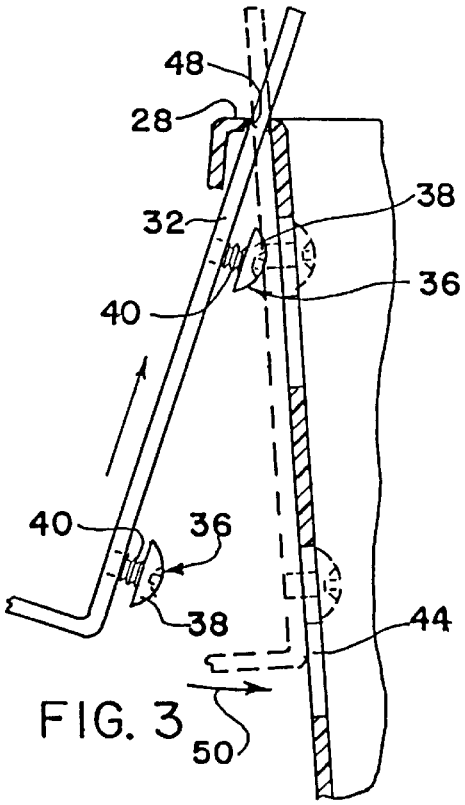
FIG. 3 a cross-sectional, fragmentary elevational view of the bracket of my invention during the initial part of its installation to the basket.
Figure 4:
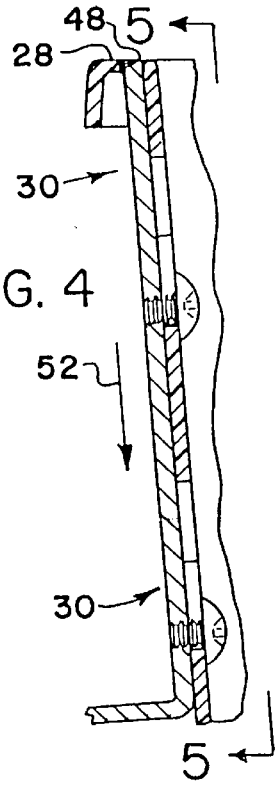
FIG. 4 is a cross-sectional, fragmentary elevational view of the bracket in its final, installed position, looking in the direction of the lines 4—4 of FIG. 5.
Figure 5:
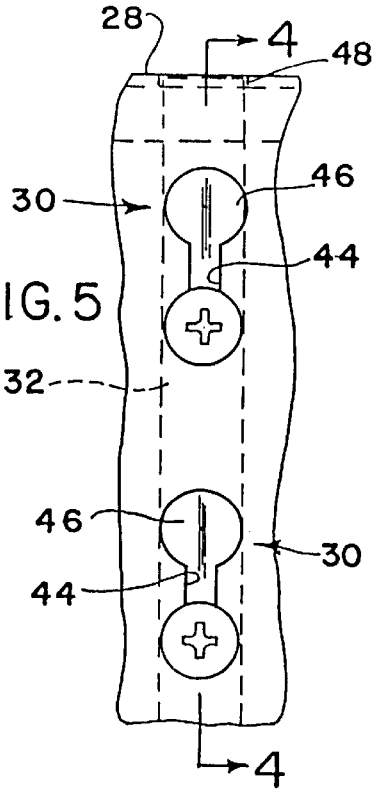
FIG. 5 is a fragmentary elevational view of the bracket mounted on the utility basket, looking in the direction of lines 5—5 of FIG. 4, from the inside of the basket.

Prior to development of the bracket-mounting design depicted in FIGS. 3–5, brackets had been fastened by self-threading screws 34 threaded into a thin wall of the basket as shown in prior art FIG. 2. Depending on the screws used, only a few threads in the wall could normally hold the screws and bracket in place. It was not intended that the brackets of the prior art FIG. 2 design ever be removed once installed at manufacture, and thus they were adequate to perform their intend function. When a heavy object was suspended from the bracket of FIG. 2, however, the wall could deflect outwardly somewhat since the strain was borne primarily at the upper screw 34. The lip 28A offered no resistance to the cantilevered force affecting the bracket, since it provided no support for the bracket. Additionally, the screws 34 extended inwardly of the compartment 18, possibly scratching material held therein or the user's fingers or hands. Of some slight concern, however, was the lack of sufficient strength to enable carrying a heavy object. Furthermore, the cost of production of the FIG. 2 design is greater than what will be disclosed hereinafter, because of the time required to install the brackets. The prior art design did not readily allow the brackets to be repositioned during use for the convenience of the user, since repositioning would gradually adversely affect the screw threads created in the plastic walls in the basket at the time of manufacture.

The improved bracket support is shown in FIGS. 3–5, where FIG. 3 shows the bracket as it appears is an initial stage of its installation, and FIGS. 4 and 5 show the bracket fully installed, from two different positions. Only a part of one bracket 32 is shown, it being understood that they are preferably provided with the basket as a pair, as shown in FIG. 1. The bracket 32 is metal and has a pair of attaching buttons 36 which are simply illustrated as screws threaded perpendicularly into a vertical portion of the bracket. The buttons 36 may also be rivets or other means, all within the scope of the invention. Each button 36 has a head 38 and a necked-down portion 40. Referring to FIG. 5, the buttons are positioned and mounted in conventional fashion in the keyhole slots 30. The slots 30 each have a vertical portion 44 slightly larger than the necked-down portion 40 and an upper hole 46 exceeding the diameter of a head 38 by a small amount to permit the head 38 to pass through its hole.

During installation of a bracket 32 to a wall 24 or 26 of the basket 12, the bracket is first brought angularly as shown in FIG. 3 and pushed upwardly through a rectangular hole 48 at the upper surface of the lip 28. Four such holes 48 are shown in FIG. 1. When the bracket is raised to the level of FIG. 3, the heads 38 align with the holes 46 of the keyhole slots 30. The bracket is then pivoted about the lip hole 48 in the direction of arrow 50 until the heads 38 pass through the holes 46. The bracket is next moved downwardly in the direction of arrow 52 of FIG. 4 until the necked-down portions 40 bottom in vertical portions 44 of the keyhole slots 30. It can be seen from FIGS. 4 and 5 that the top or distal end of the bracket is flush with the top surface of the lip 28 at that time. This additional support by the lip 28 provides a stronger mounting of the bracket to the wall, relieving leftward force on the button heads 38 as viewed in FIG. 4. The design also allows easy removal of a bracket by reversing the steps of installation, if desired. Neither installing nor removing a bracket requires use of tools, and either can be done quickly by the user if, for example, he or she wishes to position a pail of water, paint or some other item at an end rather than the far side of the basket when mounted on a stepladder as in FIG. 1. Obviously, the item supported should be removed from a bracket before a bracket is relocated.

Various chances may be made in the design without departing from the spirit and scope of the claims, including making bracket 32, button 36 and necked-down portion 40 integral and of an appropriate injection-molded plastic.

Having described my invention, I claim:

1. In a molded utility basket having an open top, a generally rectangular bottom wall, pairs of opposed side and end walls extending to essentially the same height vertically upwardly from outer edges of said bottom wall and a horizontal outwardly-directed lip surrounding said open top at the upper edges of said side and end walls, at least one manually-attachable and detachable bracket having a narrow, relatively thin, vertical straight elongated portion mounted to an outer vertical wall of said basket for suspending an object from the bracket, and an improved mounting for said bracket comprising;

a pair of spaced attaching buttons extending perpendicularly from one side of said bracket elongated portion, each button having a head on its distal end and a necked-down portion affixing said head to said bracket, which necked-down portion is of a length corresponding to the thickness of the basket walls to which said bracket is to be mounted;

a pair of vertically-aligned spaced keyhole slots in at least one of said walls, each said keyhole slot comprising an upper hole to accommodate passageway therethrough of a head of one of said attaching buttons and a narrow vertically-depending slot the width of said necked-down portion of said attaching button;

a hole in said lip vertically aligned with said keyhole slots, said hole having a shape and size generally corresponding to the cross-sectional shape and dimensions of of the elongated portion of said bracket;

said bracket having a distal portion of a length relative to an upper one of said attaching buttons whereby, during assembly of said bracket to one of said walls, said bracket distal portion enters said hole angularly relative to said wall from below into and upwardly beyond said lip hole until said heads align with said upper holes of said keyhole slots, said bracket is then pressed against said wall to pass said heads through said upper holes, and then slid downwardly to cause the necked-down portions to contact the bottoms of said vertically-depending slots; and said bracket distal portion remaining within said lip hole when said attaching buttons have reached the lower end of their travel.

2. The bracket according to claim 1 wherein the end of said bracket distal portion is generally cooplanar with the upper surface of said lip when said bracket is assembled to said lip.

3. The bracket according to claim 1 wherein a pair of said brackets are provided, said brackets being generally U-shaped, mounted at the same horizontal level and spaced apart along one side wall of said basket for supporting an elongated object horizontally between the pair of brackets.

4. The bracket according to claim 3 wherein at least one additional pair of corresponding keyhole slots and lip hole is provided in an end wall, enabling one of said brackets to be selectively removed from the side wall and installed in said additional pair of keyhole slots.

* * * * *